United States Patent [19]

Severinsen

[11] Patent Number: 5,005,272

[45] Date of Patent: Apr. 9, 1991

[54] PROCESS IN SETTING A WEB, AND A HEAT SETTING PLANT FOR SETTING WEBS

[76] Inventor: Severin Severinsen, N-1087, Oslo 10, Norway

[21] Appl. No.: 481,141

[22] Filed: Feb. 16, 1990

[30] Foreign Application Priority Data

Feb. 24, 1989 [NO] Norway ..... 890790

[51] Int. Cl.[5] ..... F26B 13/10

[52] U.S. Cl. ..... 26/106; 28/167

[58] Field of Search ..... 26/106; 28/167; 34/23, 34/155

[56] References Cited

U.S. PATENT DOCUMENTS

| | | | |
|---|---|---|---|
| 2,183,298 | 12/1939 | Offen | 34/155 |
| 3,234,662 | 2/1966 | Alexeff et al. | 26/106 X |
| 3,499,231 | 3/1970 | Mullaney | 34/155 X |
| 3,577,652 | 3/1971 | Evans et al. | 34/155 |
| 3,793,741 | 2/1974 | Smith, Jr. | 34/155 X |
| 3,812,599 | 5/1974 | Bruckner | 34/155 X |
| 3,849,904 | 11/1974 | Villalobos | 34/155 |
| 4,094,074 | 6/1978 | Schrader et al. | 34/155 X |
| 4,094,077 | 6/1978 | Schrader et al. | 34/155 |
| 4,397,103 | 8/1983 | Ruepp | 34/155 |

*Primary Examiner*—Werner H. Schroeder

*Assistant Examiner*—John J. Calvert

*Attorney, Agent, or Firm*—Browdy and Neimark

[57] ABSTRACT

In setting a web, e.g. a wire sieve or felt in a heating and setting plant, air of a desired temperature is blown towards said web. The air in the air box is heated to a desired starting temperature, the air meanwhile being redirected to circulate in the air box without flowing towards said web to any substantial degree. When the air has reached the starting temperature, it is redirected to be blown towards the running web. This procedure may be repeated as desired until the web is set as desired.

A setting plant for setting webs comprises an air box with two portions between which the web may run. At least one portion of the box acting as an active box portion, comprises equipment for air treatment. In order to heat the circulating air the flow connection between the inlet side of the equipment for air treatment, and openings in the box portion towards the box portion, and the flow connection between the outlet side of the equipment for air treatment and the nozzles, respectively, may be short-cut by the aid of suitable means. In short-cutting most of the air will circulate inside the box portion and only a negligible portion of the air will pass out to the web.

17 Claims, 8 Drawing Sheets

PROCESS IN SETTING A WEB, AND A HEAT SETTING PLANT FOR SETTING WEBS

Figure 1:
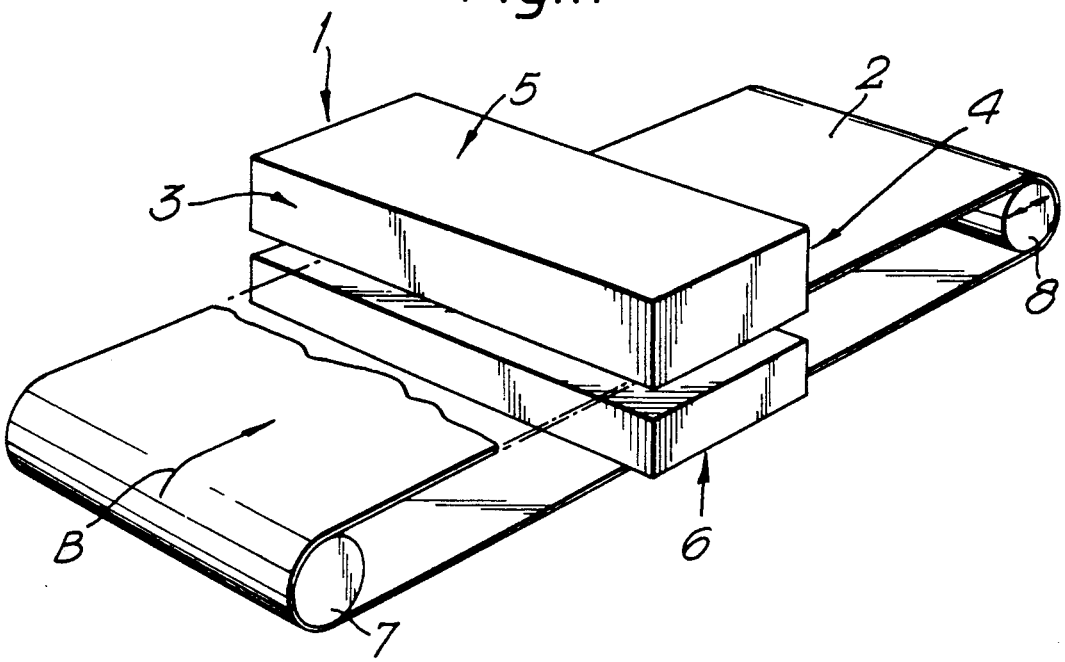

The invention relates to a process in setting a web, e.g. a wire sieve or felt, in a heating and setting plant, in which the web is run through an air box in which air at a desired temperature is blown towards the web.

The invention also relates to a heating and setting plant for setting webs, e.g. a wire sieve or felt, comprising an air box with two portions between which the web may run, one portion of the box being an active portion and comprising equipment for air treatment with an inlet side and an outlet side, and having a side facing the other portion with nozzles directed towards the other portion, and a flow connection between the outlet side and the nozzles.

In setting a wire sieve or felt the generally endless wire sieve or felt web is placed about two rollers, one of which is movable, for tensioning the web to a required degree. Between rollers the web is passed through an air box, in which air of desired temperature is blown towards the web during its passage through the air box, said web being run by driving action by one of said rollers.

Ideally, a wire sieve or felt should "see" or "receive" the same volume of air and temperature per surface unit during the setting period. This is not achieved with present equipment. Heating to a desired air temperature occurs while the web runs through the air box. When the desired air temperature is achieved, the web continues to run for a desired period, whereupon air temperature is, if desired, increased again. When the increased temperature has been reached the running web is again influenced for a desired period to achieve the desired setting. The number of temperature steps may be varied for individual web qualities. This procedure will cause the treated web not to be subjected to the desired constant influence of air and temperature. According to the invention a new process is, thus, provided. According to the invention a web is passed through an air box in which air at a desired temperature is blown towards the web. The web is placed in said air box, the air is heated in the air box to a desired starting temperature, the air being at the same time redirected to circulate in the air box without flowing towards the web to any essential degree, upon reaching the starting temperature the air is redirected to be blown towards the running web, the air is again redirected for recirculation, as mentioned, to be heated to a next temperature level, and upon reaching said next level of temperature the air is redirected to be blown towards the running web. This procedure is repeated until the web is set.

By the aid of such a process for setting a web it is achieved that each surface unit of the web "sees/-receives" the same volume of air and the same temperature during the setting period. By setting, e.g. a wire sieve in this manner the wire sieve will, thus, receive the same temperatures and air volumes all over the wire sieve.

Advantageously, the process according to the invention may be carried out by keeping the web stationary during redirection of air for circulation, and sweeping the web by preheated, preferably moist air, while the web is stationary in the air box. The supplied moisture will soften the monofilaments of the wire sieve or felt resulting in an improved profile of the web. Sweeping is considered to be especially important when the web is stationary. Without air sweeping there may be a hazard that the web is influenced by radiation heat from the box with resulting undesirable setting.

Sweeping will also be advantageous, even though the web is moved slowly or at a normal speed while air is circulated.

A setting plant according to the invention is also suggested. According to the invention a setting plant for setting webs, e.g. a wire sieve or a felt, has an air box comprising two portions, between which a web may run, at least one of said box portions being an active box portion comprising equipment for air treatment with an inlet side and an outlet side, and comprising a side facing the other portion with nozzles directed towards the other portion, and a flow connection between the outlet side and the nozzles. Said at least one box portion is in said side provided with openings for receiving air, as well as a flow connection between said openings and the inlet side of the equipment for air treatment. Means provide for a short cutting both flow connections between outlet side and nozzles.

Such a setting plant permits the desired heating of the air circulating in one or both portions without the web which is already introduced into the box being influenced to any degree worth mentioning. It is, thus possible to heat the air for treatment to a desired starting temperature without influencing the web to any degree worth mentioning. When the starting temperature is achieved the web is started or quickened to normal running speed if it does not already run at such a speed, and the air is redirected to be blown towards the running web. After a desired running period the air may by the aid of suitable redirection be brought to the next temperature level. Meantime the web may be stationary or moving. When the new temperature is achieved the web may be started again and the air is redirected to blow towards the web. This procedure may be repeated for a desired number of times until the setting treatment is considered satisfactory. During periods of redirection the web may, as mentioned, be stationary or it may be run at a reduced speed.

By the new setting plant the advantage is achieved that heating of air occurs in one and the same portion of the box, without the air having to pass through the web. The web is not subjected to the desired air influence until the desired air temperature is achieved, the air then being redirected to blow towards the web, which is driven by the driving and tensioning rollers present in the plant in a manner known per se.

A setting plant wherein the other box portion has a substantially plane and tight face towards said side of said at least one box portion is especially suitable for light and moderately heavy products, in which case it will be sufficient with air blown against one side of the web.

A setting plant wherein the other box portion is an active box portion corresponding to said one box portion is especially suited for heavy products, i.e. heavier and denser wire sieves and felt requiring active box portions for each web face.

An advantageous embodiment of the setting plant is one wherein the active box portion comprises a plenum inlet channel extending substantially across the entire box width and forming the inlet side of the equipment for air treatment, an equalizing channel extends substantially across the entire box width and forming part of the flow connection between the outlet side of the equipment for air treatment and the nozzles, a pressure channel extends substantially across the entire box width between plenum equalizing channel and nozzles and constituting part of the flow connection between the outlet side of the equipment for air treatment and the nozzles, said pressure channels having through slots or openings towards the plenum equalizing channel, and a mixing channel extends substantially across the entire box width and constituting part of the flow connection between said openings and the inlet side, said openings being made in one channel wall, with flow pipes extending from said channel to plenum inlet channel through the intermediate plenum equalizing channel the short cut means being flap valves in the wall of the mixing channel towards an adjacent pressure channel. This embodiment provides desired balancing of the air flow in the box portion, with a uniform air flow towards the running web, at the same time as it is possible in a simple manner to achieve the desired circulation for heating of the treating air in the box portion.

An arrangement of the equipment for air treatment at the ends of the air box is especially suited for air boxes intended for treatment of webs with lower and medium treating temperatures.

For heavier products (wire sieves and felt) it will be of interest to work with temperatures of a high level, i.e. up to a range of 350° C. Heavier webs and webs of great density will generally also require active box portions on each side of the web. An arrangement of the equipment for air treatment at the longitudinal sides of the air box is especially suitable for use with high operating or treating temperatures, because the equipment for air treatment, especially ventilators and their motors, will due to their location at the longitudinal sides be located outside the areas of essential heat influence.

An embodiment of the setting plant wherein two or more plenum inlet channels, and plenum equalizing channels are provided adjacent to each other in the longitudinal direction of the air box, will permit treatment at two or more levels of temperature, with a lower temperature at the inlet end and consequently improved control with shrinking in the web.

The arrangement of pressure channels on each side of the mixing channel provides an advantageous design with good flow conditions of the air.

Channels places alongside the ends of the air box for supply/discharge of air for sweeping the web provide for advantageous sweeping of the web by air, which is of special interest when the web is stationary, while the treating air is circulated to be heated. The channels are connected with a separate unit of components for air treatment, e.g. ventilators, heating batteries, devices for supply of moisture, etc.

After heating and setting treatment the plant should be cooled down. This is achieved by introduction of air from outside into and through the air box, and out to the environment, if desired to a plant for heat recovery. An advantageous design of the air box which permits such cooling in a uniform and advantageous manner is one wherein a fresh air channel and a cooling channel are provided in the air box, which channels extend substantially across the entire box width and are connected with a plenum inlet channel, and plenum equalizing channel respectively, via flap valve openings.

A desired uniform distribution of air across the running web is rendered possible in a structurally simple manner when the nozzles comprise cross bores in respective narrow cylindrical members extending in the direction of the box width, said cross bores opening into a common longitudinal groove in cylindrical member which groove opens toward the other air box portion.

Control of the air flow direction towards the running web is achieved in an advantageous manner provided said narrow cylindrical members are mounted to be rotatable about their cylindrical axes in the air box in open grooves in the internal wall of a box portion, and that they are connected with means for rotating and firmly holding them in the adjusted position, i.e. the set nozzle direction relative to a normal on the web plane. By setting the air flows from nozzles in a direction opposite to the running direction of the web a higher heat transfer from air to web may be achieved. By setting the air flow direction in the same direction as the woven pattern of the web it is possible to achieve a larger volume of air passing through the web and improved setting.

It should be possible to use a setting plant for various widths of webs. Means for covering a number of bores in order to adjust the nozzle width for adaption to the web width provide for adaption of the air flow to the width of the web.

Figure 2:
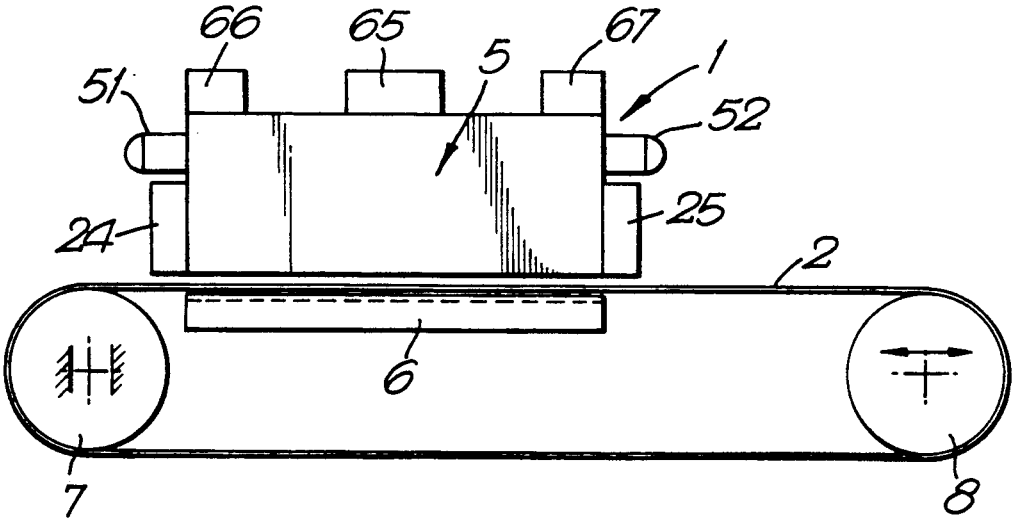
Figure 3:
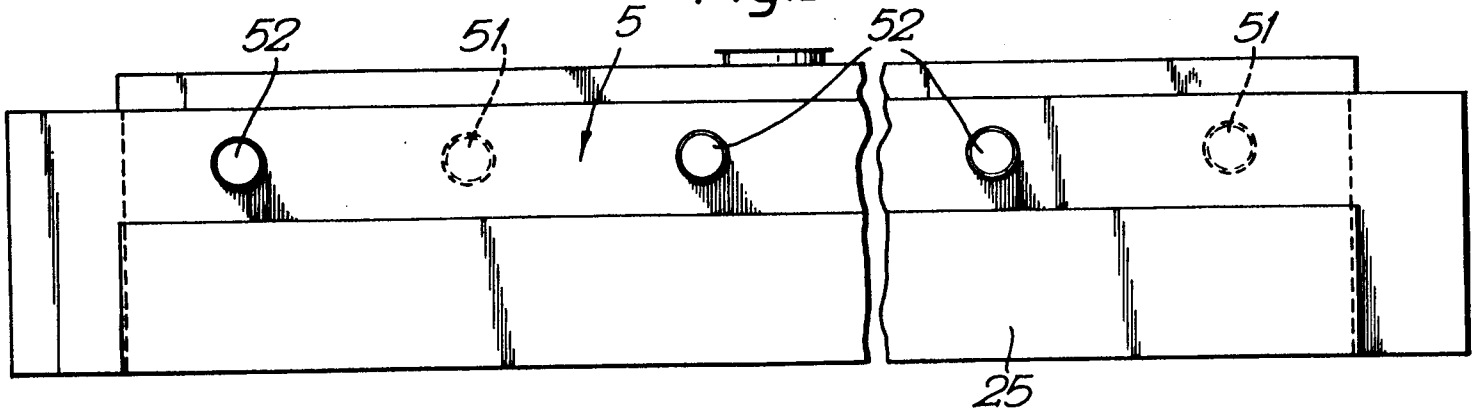
Figure 4:
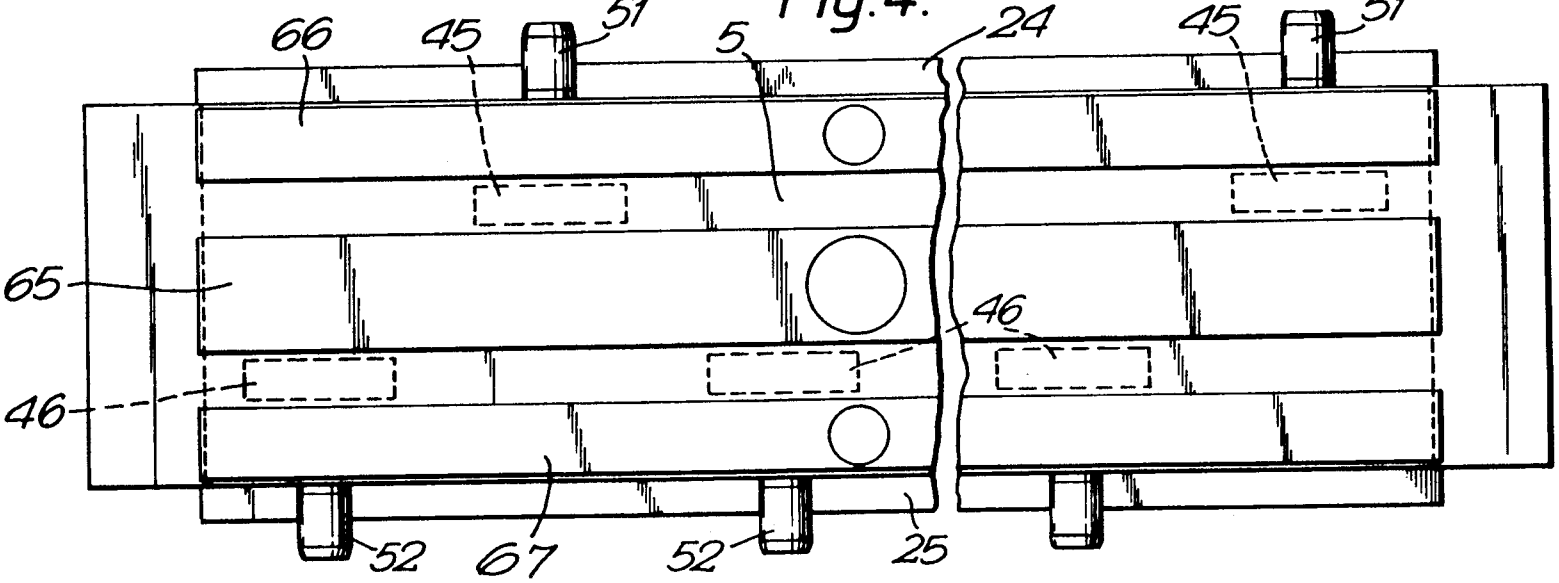
Figure 5:
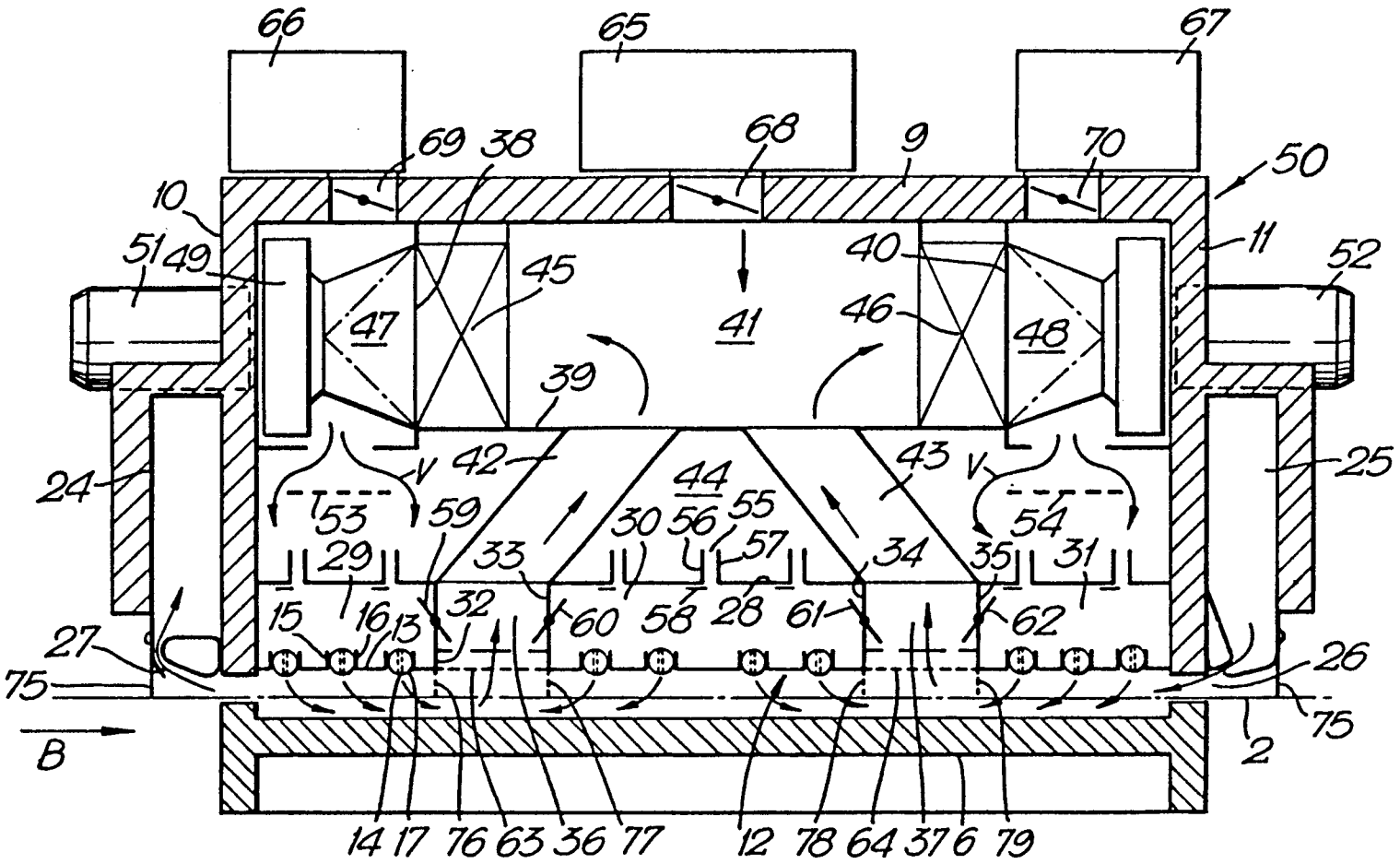
Figure 6:
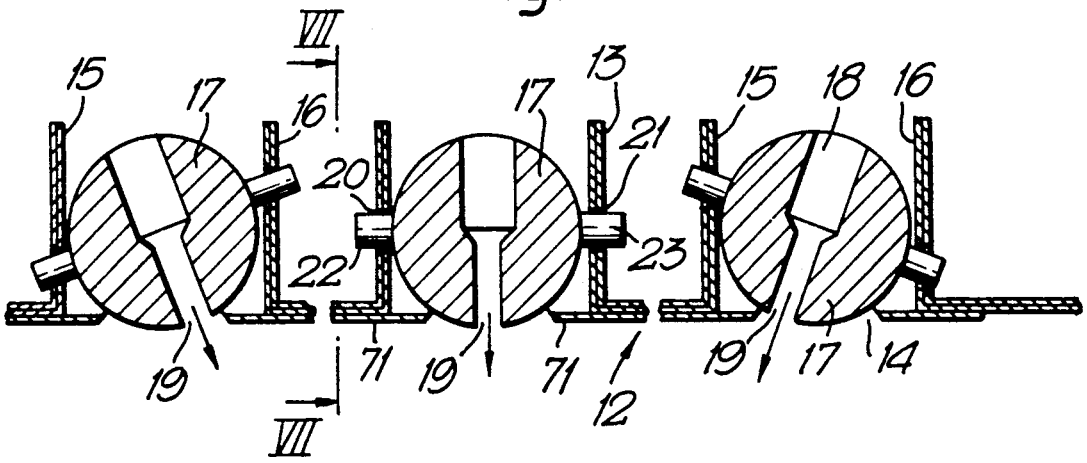
Figure 7:
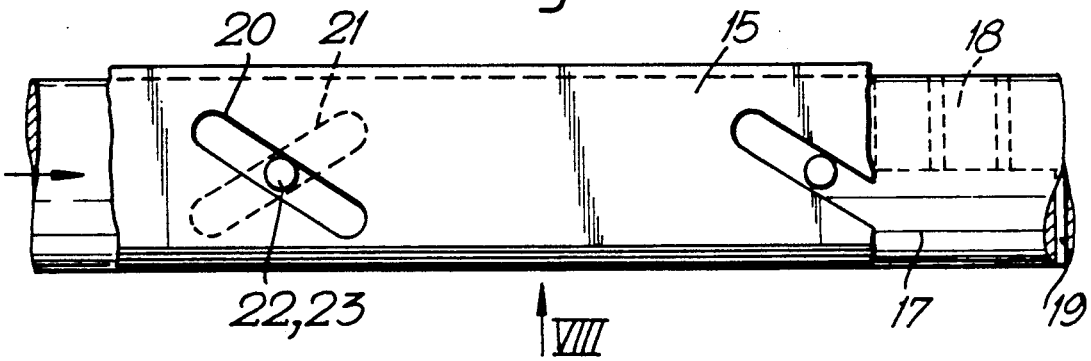
Figure 8:
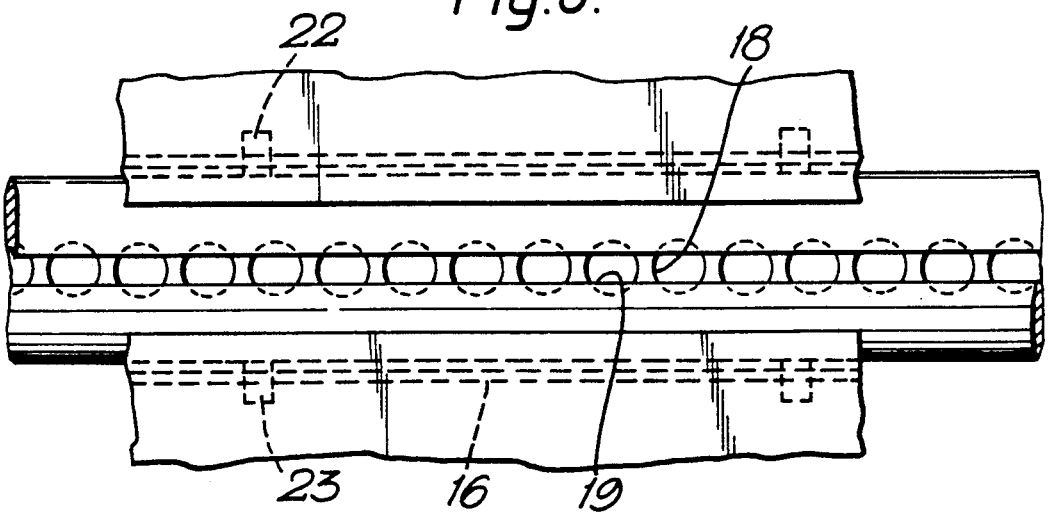
Figure 9:
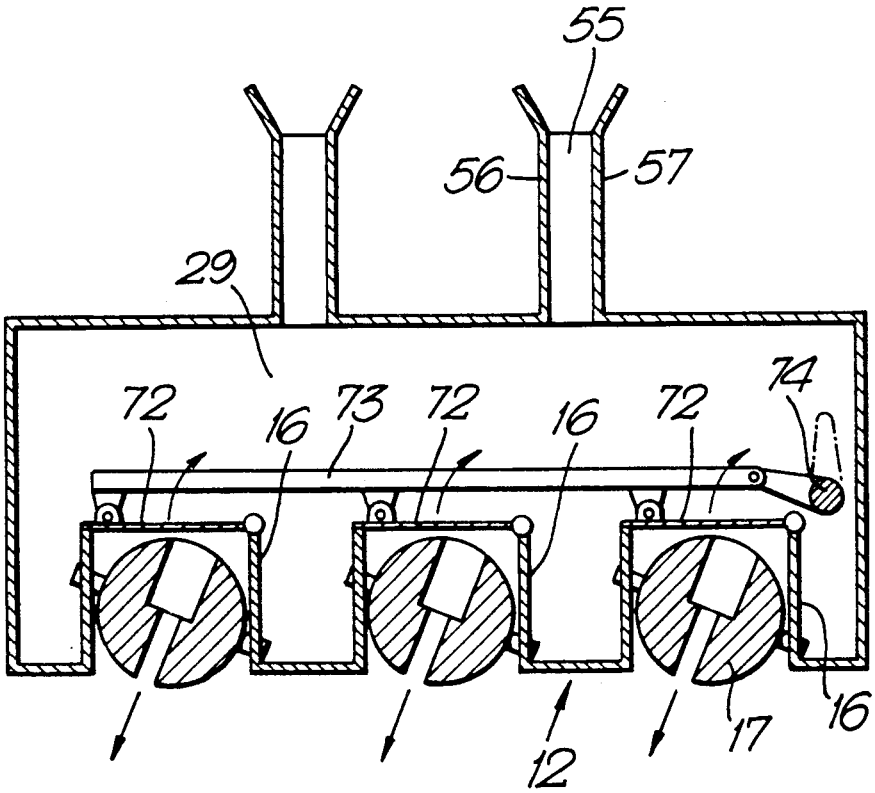
Figure 10:
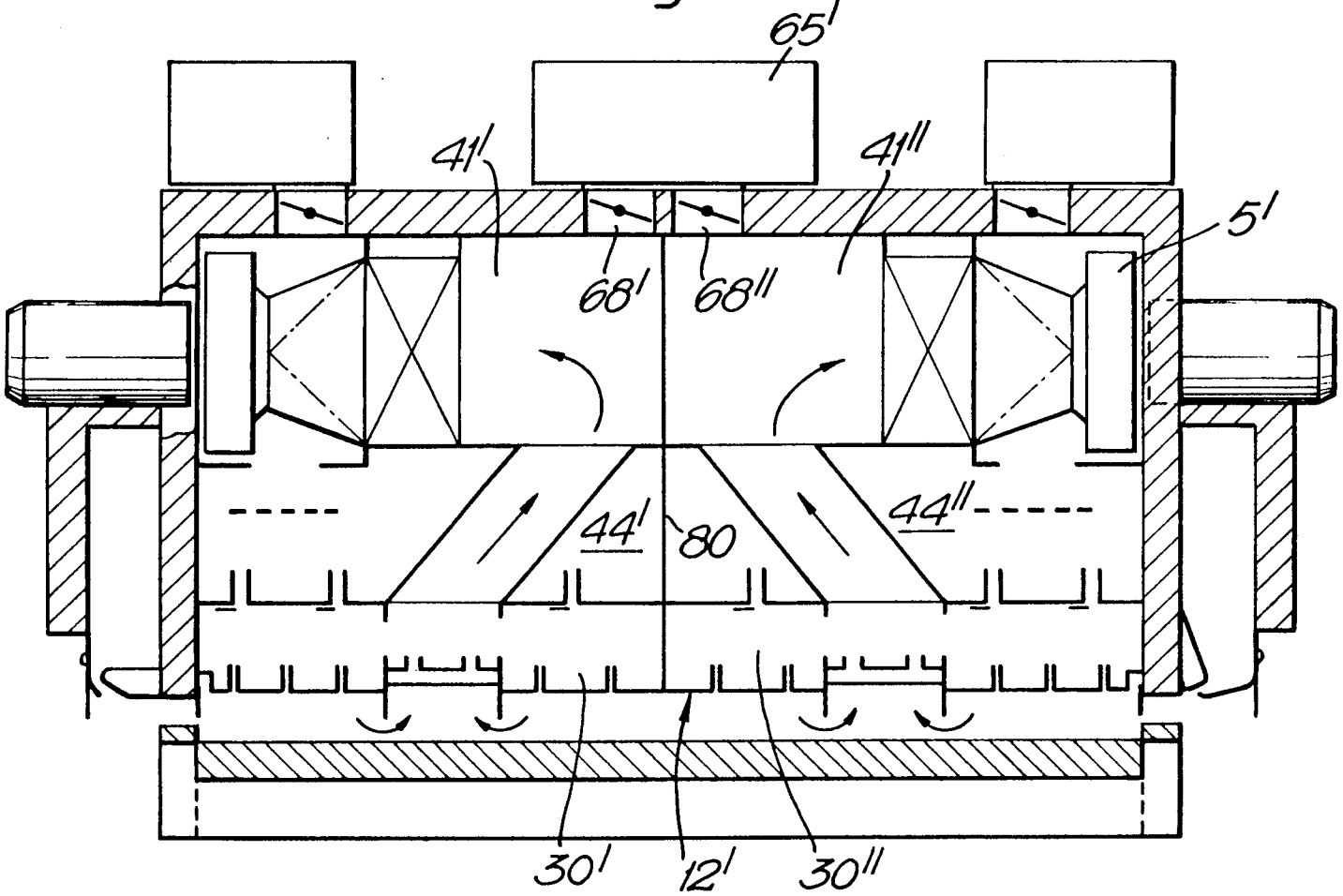
Figure 11:
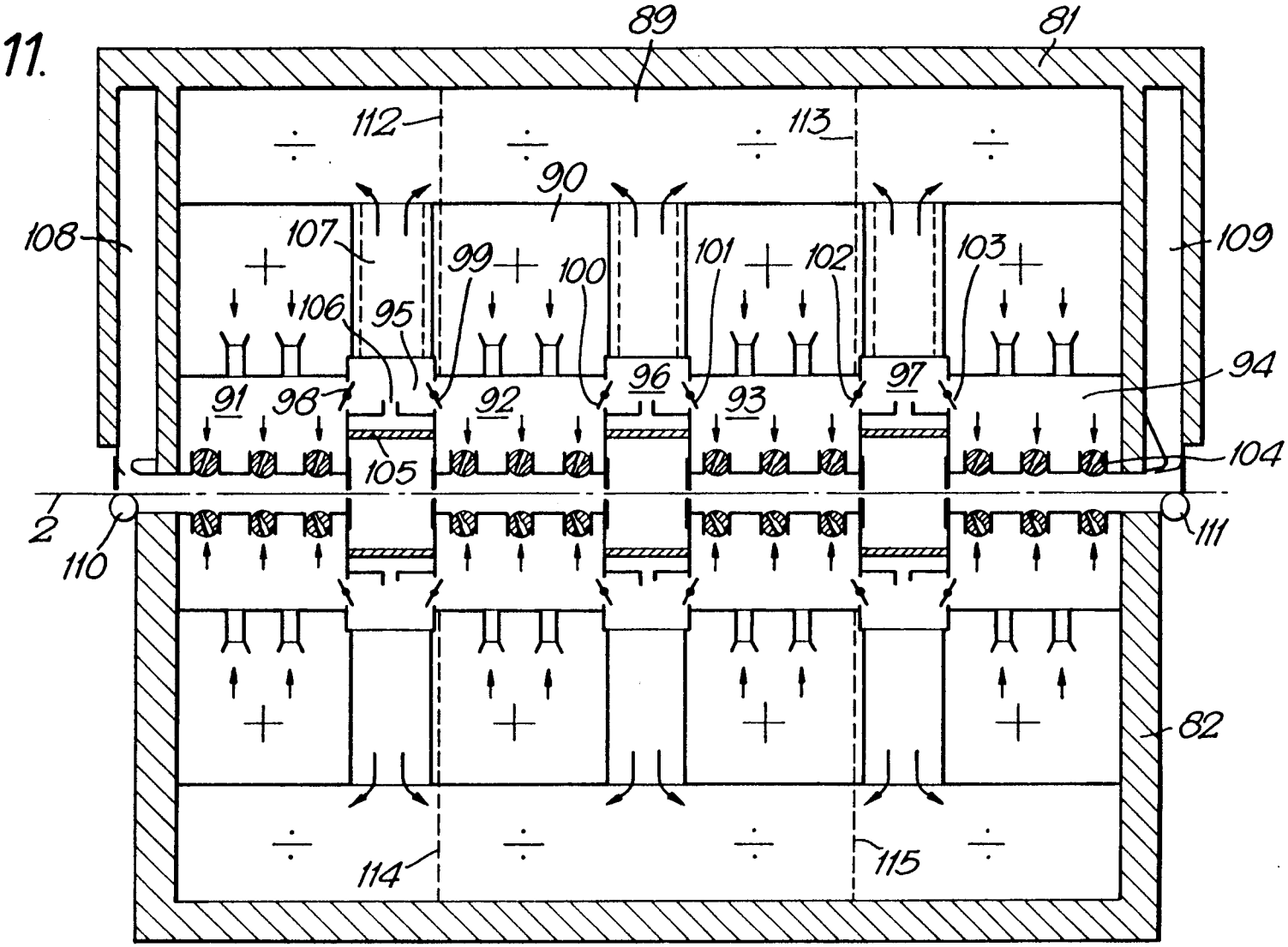
Figure 12:
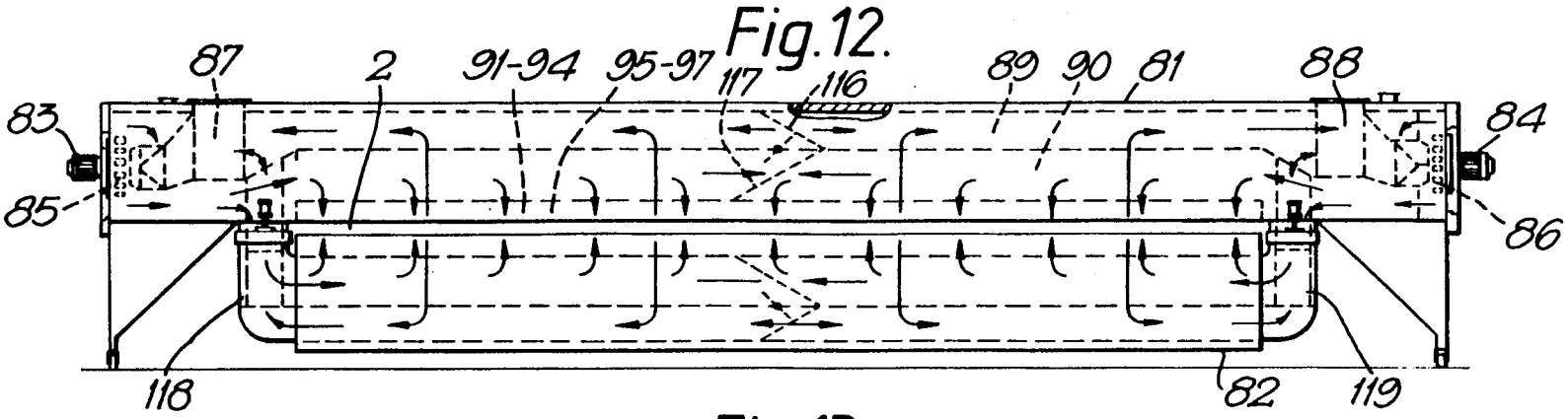
Figure 13:
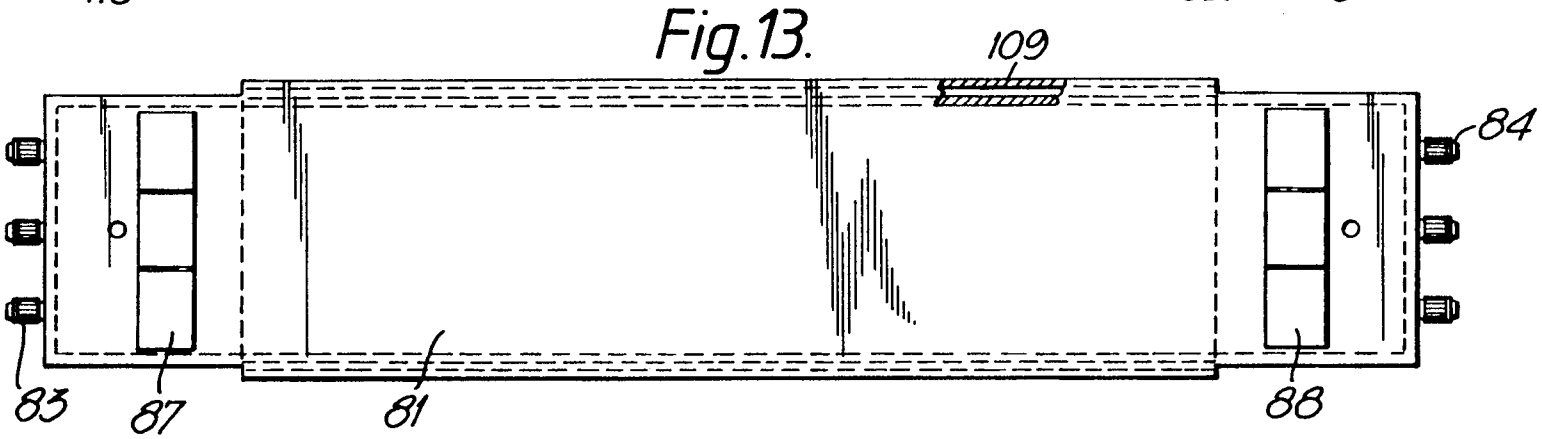
Figure 14:
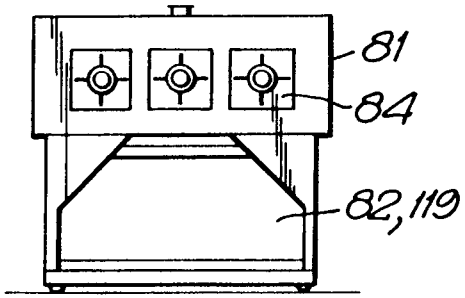

A simple mechanical bearing and control means for the cylinder members is one wherein the respective cylindrical members are flanked by flanges edges which project into the box portion and are provided with oblique grooves the cylindrical member having diametrically opposed projecting pins engaging in mutually opposed oblique grooves extending in opposite directions in both flange edges. The invention shall now be disclosed in more detail with reference to the drawings, in which FIG. 1 is a diagrammatical view in perspective of a heating and setting plant, FIG. 2 shows a heating and setting plant in a diagrammatical lateral elevation, FIG. 3 shows the active portion of the air box, as seen from the inlet end, FIG. 4 is a top view of the box portion of FIG. 3, FIG. 5 is a longitudinal section through the air box, in a diagrammatical enlarged view, FIG. 6 shows an enlarged detail, representing the area just above the area marked 6 in FIG. 5, FIG. 7 is a sectional view along line VII—VII in FIG. 6, FIG. 8 is an elevational view, as seen in the direction of arrow VIII in FIG. 7, FIG. 9 shows a detail from the same area as FIG. 6, with a diagrammatically indicated closing means for the nozzles, FIG. 10 shows a portion of a box showing the same build as the box portion of FIG. 5, but partitioned internally to provide two working/temperature areas of the air box, FIG. 11 is a sectional view through an air box comprising two active box portions, one on each side of the web, and especially intended for heavier products, FIG. 12 shows the air box of FIG. 11, as seen from its inlet end and in a smaller scale than in FIG. 11, FIG. 13 is a top view of the air box of FIG. 12, and FIG. 14 shows the air box of FIGS. 12 and 13 in a lateral elevation, i.e. as seen from the longitudinal side of the web. With reference to FIG. 1 some concepts and designations used below shall be explained. Air box 1, as shown in FIG. 1, is shown to be an elongated box structure extending with what is generally called its longitudinal direction across the width of the shown web 2. Even though box 1 has its largest dimension in the direction of the main axis of the box structure, said dimension is nevertheless designated as the width of the box—in keeping with the width of the web. Correspondingly, the box dimension in the direction of the web (moving direction of the web, as indicated by arrow B) is designated as the length of box 1. Side 3 of the box extending across web 2 and facing the moving direction of the web (arrow B) is called the inlet end of the box. Correspondingly, the opposite side of the box is called outlet end 4 of the box. The air box comprises of two portions, i.e. an external box portion 5 and an internal box portion 6. These terms were chosen because external box portion 5 is outside the web loop, whereas the internal box portion is inside the web loop. Correspondingly, the inner wall of a box portion is the wall or side facing the other portion, i.e. the web. The outer wall or side is the box wall or side facing outwards, i.e. away from the web.

The actual short sides of the box extending in parallel with the direction of movement of the web are called box sides.

As shown in FIG. 1, see also FIG. 2, the air box is built from two box portions 5 and 6, with web 2 being guided between them. Web 2 is placed about two rollers 7 and 8. One of said rollers may be stationary, whereas the other is mounted for motion as indicated by double arrow adjacent roller 8, and this roller then acts as a tensioning roller.

The external box portion 5 is built to form an elongated box member with a top wall (in FIG. 5), end walls 10 and 11, and a bottom wall or inner wall 12. The hatched box walls 9, 10, etc. are heat insulated. Box wall 12 is suitably manufactured from plate material and is built from plate sections 13, which are bent into U-shape and are provided at a mutual distance. In this manner intermediate openings 14 are formed which extend in the direction of the web width and are in the box space flanked by flange edges 15 and 16 extending in the direction of width.

Between respective flange edges 15, and 16 an elongated cylindrical member 17 is positioned to extend substantially across the entire width of the box. In each cylindrical member 17 holes 18 are drilled, approximately to the middle of the cylindrical member, where bores 18 open into a diametrically opposed open slot or groove 19 extending continuously in the longitudinal direction of the cylindrical member, i.e. in the direction of the air box width. Bores 18 and groove 19 form nozzles for blowing air towards web 2.

In flange edges 15 and 16 grooves 20, 21 (see especially FIG. 7) are made to extend opposite to each other and in opposite directions. From cylindrical member 17 diametrically opposed pins 22, 23 project and engage in respective adjacent oblique grooves 20, 21.

If cylindrical member 17 is displaced as indicated by the arrow in FIG. 7, cylindrical member 17 will rotate. In this manner cylindrical members 17 and their nozzles are adjusted at various angles relative to the normal on the web, as shown in FIG. 6. The direction of the air flow from grooves 19 can thus be controlled as indicated by arrows in FIG. 6. In this connection reference is also made to indicated air flow arrows from nozzles shown in FIG. 5.

On the inlet end of box portion 5 a channel 24 is provided to extend along the entire width, and on the outlet end a channel 25 is correspondingly provided to extend substantially along the entire width of the box.

Channels 24 and 25 act as channels for sweeping web 2 with air, preheated air being blown from channel 25 through a slot 26 at the inner side of the channel, i.e. the side facing web 2. Such air will sweep along the web 2 in a direction opposite to running direction B of the web and pass into channel 24 through a slot 27. Said sweeping is used when web 2 is stationary and the air circulates in said box portion.

Channels 24 and 25 are connected with a separate unit (not shown) of air treatment components, e.g. ventilator, heating battery, device for supplying moisture, etc. Inside box portion 5 at a distance from nozzle wall 12 of the box a partition 28 is provided limiting pressure channels 29, 30, 31 with wall 12, said channels extending all over the width of the box. By the aid of walls 32, 33, 34, and 35 extending in the direction of width so called mixing channels 36, 37 are formed between wall 12 and wall 28. The mixing channels also extend across the entire width of the box.

Towards outer wall 9 of the box portion a space extending across the width of the box, here designated plenum inlet channel 41 is formed by walls 38, 39, and 40 which are manufactured from sheet metal.

From mixing channels 36 and 37 pipes or channels 42, 43 extend to plenum inlet channel 41. Such pipes or channels 42, 43 may be provided in a desired number across the width of the box and they span a central space 44, extending across the entire width of the box and here being designated plenum equalizing channel 44.

Along walls 38 and 40 in plenum inlet channel 41 a plurality of heating batteries 45, 46 are distributed across the width, see also FIG. 3. Heating batteries 45, 46 are by the aid of respective conical channel sleeves 47, 48 connected with a ventilator 49, and 50, respectively. Each said ventilator 49, 50 is driven by an electromotor 51, 52 (see also FIGS. 3 and 4).

In operation ventilators 49, 50 will suck air from plenum inlet channel 41 and deliver air to plenum equalizing channel 44, as indicated by arrows V.

Air flows V are deflected in a suitable manner by deflector plates 53, 54 in plenum equalizing channel 44.

In wall 28 a number of openings 55 are provided to let air flow from channel 44 down into the pressure channels 29, 30, and 31, respectively. Openings 55 may have various shapes. They may, e.g. be circular holes, elongated grooves, etc., preferably being limited by the indicated walls 56, 57 projecting into the plenum equalizing channel. At 58 closing plates are indicated by the aid of which openings 55 may be more or less closed, as required. Said closing plates 58 are slidable into and from a closing position in a manner not shown, using technology known to those skilled in the art.

In the above mentioned walls 32, 33, 34, and 35 flap valves 59, 60, 61, and 62 are provided. They preferably comprise simple pivotal flaps, i.e. round openings in the walls with round pivotally mounted flap members in the respective openings. The flap valves are adjustable by simple means known to those skilled in the art, e.g. the flaps in one and the same wall may be connected with a common central revolving rod.

In FIG. 5 the flap valves are shown in a half-open position. Said flap valves 59, 60, 61, 62 are used to redirect the air in box portion 5, i.e. to short-cut the air flow, so that only a negligible portion of air will pass through the nozzles in nozzle member 17 when the flap valves are open. This is due to the higher flowing resistance in nozzles relative to the open flap valves. From channel 41 air is then forced into channel 44 by the aid of ventilators 49, 50 and will pass from there through openings 55 into pressure channels 29, 30, and 31, respectively. Through the open flap valves 59, 60, 61, 62 air will then pass into mixing channel 36, and 37, respectively and through channels 42, 43 back to plenum inlet channel 41. As mentioned, the higher resistance in nozzle members 17, i.e. in bore 18, will result in only a negligible volume of air to pass through the nozzles. The air, thus, circulates in box portion 5. When air is to be passed through the nozzles to influence web 2, flap valves 59, 60, 61, and 62 are closed. Then air will pass through the nozzles and blow through web 2. The air flow will be reflected or deflected by the second box portion 6, which is mainly designed as a plane surface facing web 2, and the air will then flow back to plenum inlet channel 41 through mixing channels 36, 37 and channels 42, 43. Mixing channels 36, 37 are open towards web 2, being limited towards web 2 by a perforated wall 63, 64, as indicated by dashed lines in FIG. 5.

Outside wall 9 a fresh air channel 65 and two cooling channels 66, 67 are provided. Said three channels extend across substantially the entire box width and are connected with plenum inlet channel 41 and the respective ventilator spaces, respectively, and thus plenum equilizing channel 44 through flap valve openings 68, 69, 70.

Upon heat and setting treatment the plant should be cooled down. This is achieved by letting air from outside pass into and through the air box, and out to the environment, possibly to a plant for heat recovery. Fresh air channel 65 and cooling channels 66, 67 are used during said cooling. Flap valves 68 are permanently adjusted to provide equal (uniform) pressure division into the box portion when air is introduced from outside to channel 65 and on to the box portion when the box is cooled. The air will then pass out through cooling channels 66, 67, and e.g. to the environment or to a plant for heat recovery. Flap valves 69, 70 are also permanently adjusted. Cooling of the box is necessary due to the fact that the equipment (especially the motors) cannot be stopped until the temperature has been lowered.

As mentioned above, individual cylindrical members or nozzle members 17 may be rotated to direct the blowing out air flow in a desired direction towards the passing web. This is shown in FIG. 6, also illustrating utilization of sealing plates 71 which are attached to wall 12 and are in sealing contact with the respective nozzle member 17 to prevent air from passing there.

As mentioned, it may be desirable to be able to adjust the width of the box in keeping with the width of the web to be treated. This means that some of the nozzle bores 18 are closed. This may be achieved by an arrangement as shown in FIG. 9, which shows flaps 72 which are pivoted on the flange edges 16. By the aid of a rod 73 flaps 72 are operatively connected with a shaft 74. Shaft 74 is pivotally mounted in the box in a manner not shown in detail. When shaft 74 is rotated, i.e. turned clockwise in FIG. 9 it will turn flaps 72 into an open position, via rod 73, and vice versa. Such flaps are provided at the respective ends of nozzle members 17, permitting the nozzle width to be reduced corresponding to the width of the web to be treated. Other possible operating mechanisms are possible and will be known or close at hand to those skilled in the art.

At ends 10 and 11 of the box sealing strips 75 (FIG. 5) are provided towards the web. At mixing channels 36, 37 suitable sealing strips 76, 77, 78, and 79 are provided to seal between pressure zone and suction zone and to cause the air flow from the nozzles to pass through the web and towards internal box portion 6, and thence back through the web and into mixing channels 36, 37.

Box portion 5' shown in section in FIG. 10 is built like box portion 5 in FIG. 5. The only difference is that centrally in the box portion a partition 80 is placed to divide plenum inlet channel 41, as shown in FIG. 5, and plenum equalizing channel 44, as shown in FIG. 5 into two parallel respective channels 41', 41, and 44' and 44'', respectively. Wall 80 extends all the way down to bottom wall 12' corresponding to bottom wall 12 in the embodiment of FIG. 5 and, thus, also divides the central pressure channel 30 of FIG. 5 into two pressure channels 30', 30''. Fresh air channel 65' is connected with both inlet channels 41', 41'', via respective flap openings 68' and 68''.

In this manner the air box is divided in an advantageous manner, permitting operations at two different levels of temperature, with a lower temperature at the inlet end at the left hand side of FIG. 10, and correspondingly improved control of web shrinking.

FIGS. 11–14 show an air box intended for treatment of heavier products, e.g. heavier and more dense wire sieves and felt members. For such heavier (more dense, thicker wire sieves and felt) products it will be desirable to operate at temperatures up to a range of 350° C. Heavier and more dense webs may also require active box portions on each side of the web. The air box shown in FIGS. 11–14 is intended for such applications and, thus, comprises two active box portions, one acting towards the outside of the web, and one affecting the inside of the web (in the web loop).

The air box, thus, comprises an external, active box portion 81, and an opposite internal active box portion 82. The equipment for air treatment is placed on the longitudinal sides of external box portion 81, and in FIGS. 12–14 such equipment for air treatment is shown to comprise electromotors 83 and 84 with associated ventilators 85, 86 and heating batteries 87, 88.

It will appear from the sectional view in FIG. 11 that each box portion is in principle designed like box portion 5 in FIG. 5. Box portion 81 is, thus, internally divided into a plenum inlet channel 89 extending across the box width, a plenum equalizing channel 90 extending across the box width, and pressure channels 91, 92, 93, and 94 extending across the box width. Between pressure channels mixing channels 95, 96, and 97 extend across the box width. In the walls separating pressure channels and mixing channels flap valves 98, 99, 100, 101, 102, and 103 are provided. Mixing channels 95, 96, 97 are open towards web 2 which is indicated by a dashed line.

As in the embodiment shown in FIG. 5, nozzle members 104 corresponding to nozzle members 17 in FIG. 5 are provided.

In the mixing channels 95, 96, 97 air filters 105 and equalizing openings 106 are provided.

Between mixing channels 95, 96, 97 and plenum inlet channel 89 pipes or channels 107 are provided which correspond to the oblique channels or pipes 42, 43 in FIG. 5. They form flowing connections between mixing channels and inlet channels.

On each end of box portion 81 channels 108, 109 corresponding to channels 24, 25 in FIG. 5 extend across the width of the box.

Internal box portion 82 is designed like external box portion 81, apart from channels 108 and 109. At the inlet end of internal box portion 82 a supporting pipe 110 for web 2 extends across the width of the box, and correspondingly, a web supporting pipe 111 is provided at the outlet end.

Air passage in the air box will appear from air flow arrows in FIGS. 11 and 12, which indicate te air flow when the web is treated with air. In the same manner as in case of the first embodiment air may be redirected in the respective box portions by opening flap valves 98–103. Then the air will circulate in the respective box portions and will only to a negligible degree pass out through nozzles in nozzle member 104.

The arrangement of equipment for air treatment 83–88 on the box sides results in said equipment being placed outside the heat treatment area of web 2 in an advantageous manner. Especially the inner box portion 82 which is placed inside the web loop may be unduly influenced by heat from the web and it is, thus, advantageous for this box portion not to have associated equipment for air treatment located in the radiation heated area, but rather in relatively radiation free areas so that especially radiation from the web does not result in high and disadvantageous heat influence on the motors. As mentioned, the embodiment shown in FIGS. 11–14 is especially intended for high temperatures (e.g. up to 350° C.).

Dashed lines 112, 113 and 114, 115 indicate how inlet channels 89 and equalizing channels 90 in both box portions 81 and 82 may be divided into three spaces extending in parallel in the direction of box width. The box portions are, thus, divided into three sections and each section may be served by its own equipment for air treatment, comprising an electromotor 83, a ventilator 85, and an associated heating battery 87 at each side of the air box. Thus, the same advantages are achieved as mentioned above in connection with the embodiment shown in FIG. 10, i.e. it is possible to divide the air box in such a manner that it will be possible to operate with three temperature levels in the present case, with a lower temperature at the inlet end and with improved control of shrinking in the web. Generally, the three temperature ranges will show relatively low mutual differences. It will be a question of a few centigrades, e.g. 5° C.

Pipes or channels 107, as indicated by dashed lines, are designed with double walls and insulation inserted between them. In order to differentiate between suction fronts and pressure fronts perforated partitions 116 and 117 (see FIG. 12) may advantageously be centrally placed in inlet channel 89 and equalizing channel 90.

Inlet channel and equalizing channel in internal box portion 82 are connected with the inlet side, and outlet side, respectively of the equipment for air treatment by vertical channels 118, 119 at each side, as shown in FIG. 12.

Having described my invention, I claim:

1. In a method in setting a web, e.g. a wire sieve or a felt, in a heating and setting plant, in which said web is passed through an air box in which air at a desired temperature is blown towards the web, the improvement comprising the steps of:

placing the web in said air box;

heating the air in said air box to a desired starting temperature;

redirecting the air at the same time to recirculate in the box without excessive flow towards the web;

redirecting the air, upon reaching said starting temperature, to be blown towards the web while said web is running;

redirecting the air for recirculation;

heating said air to a next temperature level;

redirecting the air to be blown, upon reaching said next level of temperature, towards the running web; and repeating the above steps until the web is set.

2. A method as stated in claim 1, further comprising the step of keeping the stationary during redirection of air for circulation, and sweeping the web while it is stationary in the air box with preheated, preferably moist air.

3. In a setting plant for setting webs, e.g. a wire sieve or a felt, with an air box comprising two portions, between which web, runs, at least one of said box portions being an active box portion comprising equipment for air treatment with an air inlet side and an air outlet side, and comprising a side facing the other portion with nozzles directed towards the other portion, and a flow connection between the outlet side and the nozzles, the improvement, in that said at least one box portion is in a side provided with openings for receiving air, as well as a flow connection between said openings and the inlet side of the equipment for air treatment, and in means for short cutting both flow connections between an air outlet side and nozzles.

4. A setting plant as stated in claim 3, wherein the other box portion has a substantially plane and tight face towards said side of said at least box portion.

5. A setting plant as stated in claim 3, wherein the other box portion is an active box portion corresponding to said one box portion.

6. A setting plant as stated in claim 3, wherein the active box portion, comprises a plenum inlet channel extending substantially across the entire box width and forming the inlet side of the equipment for air treatment, an equalizing channel extending substantially across the entire box width and forming part of the flow connection between the outlet side of the equipment for air treatment and the nozzles, a pressure channel extending substantially across the entire box width between plenum equalizing channel and nozzles and constituting part of the flow connection between the outlet side of the equipment for air treatment and the nozzles, said pressure channels having through slots or openings towards the plenum equalizing channel, and a mixing channel extending substantially across the entire box width and constituting part of the flow connection between said openings and the inlet side, said openings being made in one channel wall, with flow pipes extending from said channel to plenum inlet channel through the intermediate plenum equalizing channel, the short cut means being designed flap valves in the wall of the mixing channel towards an adjacent pressure channel.

7. A setting plant as stated in claim 6, wherein the other box portion as an active box portion corresponding to said at least one box portion.

8. A setting plant as stated in claim 6, wherein the equipment for air treatment is placed at ends of the air box.

9. A setting plant as stated in claim 6, wherein the equipment for air treatment is placed at longitudinal sides of the air box.

10. A setting plant as stated in claim 6, wherein two or more plenum inlet channels, and plenum equalizing channels are provided adjacent to each other in longitudinal direction of the air box.

11. A setting plant as stated in claim 6, wherein a pressure channel is arranged on each side of a mixing channel.

12. A setting plant as stated in claim 3, having channels placed alongside the ends of the air box for supply/discharge of air for sweeping the web.

13. A setting plant as stated in claim 3, wherein a fresh air channel and a cooling channel are provided on the air box, which channels extend substantially across the entire box width and are connected with plenum inlet channel, and plenum equalizing channel, respectively, via flap valve openings.

14. A setting plant as stated in claim 3, wherein the nozzles comprise cross bores in respective narrow cylindrical members extending in the direction of the box width, said cross bores opening into a common longitudinal groove the in the cylindrical member which groove opens toward the other air box portion.

15. A setting plant as stated in claim 14, wherein said narrow cylindrical members are mounted to be rotatable about their cylindrical axes in the air box in open grooves in an internal wall of a box portion, and that they are connected with means for rotating and firmly holding them in an adjusted position, i.e. the set nozzle direction relative to a normal on the web plane.

16. A setting means as stated in claim 14, having means for covering a number of bores in order to adjust the nozzle width for adaption to the web width.

17. A setting plant as stated in claim 14, wherein the respective cylindrical memebers are flanked by flange edges which project into the box portion and are provided with oblique grooves, the cylindrical member having diametrically opposed projecting pins engaging in mutually opposed oblique grooves extending in opposite directions in both flange edges.

* * * * *